United States Patent [19]

Russell

[11] 3,939,982

[45] Feb. 24, 1976

[54] DOCUMENT TRANSPORTATION CASE

[76] Inventor: Carroll E. Russell, Rte. 5, Box 508, Wetumpka, Ala. 36092

[22] Filed: Mar. 20, 1975

[21] Appl. No.: 560,516

[52] U.S. Cl. ..... 206/509; 206/425; 206/74; 220/4 B; 220/17; 190/35

[51] Int. Cl.[2] B65D 51/18; B65D 1/34; B65D 21/02; B65D 85/54

[58] Field of Search ..... 206/503, 499, 509, 74, 206/425; 220/4 B, 4 E, 17, 22.5, 334; 190/16, 35; 217/7

[56] References Cited

UNITED STATES PATENTS

| | | | |
|---|---|---|---|
| 863,944 | 8/1907 | Sampson | 220/22.5 |
| 2,347,192 | 4/1944 | Grice | 190/35 |
| 2,436,097 | 2/1948 | Clarke | 206/499 |
| 3,241,706 | 3/1966 | Monaco | 220/17 |
| 3,258,017 | 6/1966 | Albert | 220/17 |
| 3,640,421 | 2/1972 | Conway | 220/22.5 |
| 3,747,796 | 7/1973 | Kneier | 220/334 |
| 3,786,913 | 1/1974 | Crawford | 217/7 |

*Primary Examiner*—George E. Lowrance
*Attorney, Agent, or Firm*—Mason, Fenwick & Lawrence

[57] ABSTRACT

A document transportation case is provided for transporting computer data cards, checks, other data documents (hereinafter "data card" or "data cards") and computer printouts, said document transportation case includes a cover having a recessed upper surface for receiving the bottom of a second document transportation case stacked thereon, said cover having recessed front and back edges which protect closure means fixed within the recesses of the front and back edges, a case container having sidewalls which fit inside the case cover and interlock therewith to strengthen the case and protect the data cards and printouts contained therein, said case container having recessed front and rear edges similar to the case cover for protecting a case handle and complementary closure means which cooperate with the closure means on the case cover to retain the cover on the container, said case container having a downwardly projection storage recess in the bottom thereof which fits in the recess of an adjacent case cover when the cases are stacked and provides a storage compartment for the computer printouts, and data card carrying trays which fit within the compartment formed by the case cover and the case container, said carrying trays have handles to simplify removal from the case container and said trays rest on a lip formed between the storage recess and the sidewalls of the case container.

10 Claims, 4 Drawing Figures

16
71
70
72
76
34
36
40
38
42
34
30
34
42
28
30
12
42
34
28
36
26
26
42
12
30
68
56
66
68
50
48
46
47
44
54
58
62
18
64
60
52
18
14
62
10

DOCUMENT TRANSPORTATION CASE

This invention is in the field of document transportation cases and the like, and is more specifically directed to a unique and convenient case for transporting and storing computer data cards and computer printouts.

Computer data cards and printouts have become essential ingredients in most fields of commerce. Many computer users are too small to have a computer processing facility at each location and therefore most computer users have a central computer data processing center which services a large number of locations thereby necessitating the transportation of the data cards produced at each location to the central processing facility. The data cards must then be returned to each location with the computer printouts which provide the desired information from the computer data cards.

This transporting of computer data cards and computer printouts frequently exposes the cards and printouts to outside weather and to the rigors of bulk handling such as in messenger service, buses or taxicabs. Mutilation of the data cards increases the cost in processing the data cards because of stoppages occurring in the card handling equipment and due to the difficulty of reading mutilated or damaged computer printouts.

A previous solution to this problem has been to use cardboard boxes sized to contain the computer data cards and then stuffing the computer printout into the box adjacent the computer data cards. These boxes do not protect the cards against rain or hard handling due to the relative weakness of the cardboard. These cardboard boxes are difficult to stack because no handles are provided and since the boxes do not interlock with one another, the stacks of boxes tend to be unstable thereby limiting the height to which the boxes can be stacked.

While metal trays have also been used, these have proven unsatisfactory. Metal trays and covers are easily bent and frequently damage other surfaces against which they come in contact. The covers often become deformed thereby making reassembly of the cases difficult.

The carrying of these previously known transportation cases from place to place has been difficult and cumbersome because they lack a convenient handle with which they may be carried. It has been quite a normal sight at a data processing facility to see an individual with three or four cardboard boxes being carried under his arm while attempting to transport the cards from one location to another. The dropping of the data card transporting cases has been quite disastrous because data cards tend to slide out across the floor like playing cards thereby becoming scrambled, and it is only with great difficulty that the cards may be sorted into their original order. Many an unhappy computer user has suffered the frustration of having to sort his computer data cards after a tray has spilled.

It is consequently the primary object of this invention to provide a new and improved document transportation case for carrying computer data card and computer printouts.

It is another object of the present invention to provide document transportation cases having recessed covers to receive the bottom of a case stacked thereon to produce interlocking stacks of transportation cases.

It is a further object of the present invention to provide a document transportation case having removable trays for receiving and retaining the computer data cards and a compartment in the bottom of the case to receive and retain the computer printouts.

A still further object of the present invention is to provide a document transportation case having a cover which overlaps and interlocks with a case container forming the bottom of the case to strengthen the case and to provide protection from rain and the like for the computer data cards and computer printouts carried therein.

It is an additional object of the present invention to provide a document transportation case having recessed front and back edges to protect closure means for retaining the cover on the case container.

An additional object of the present invention is to provide a document transportation case which is capable of carrying two trays of computer data cards and a quantity of computer printouts in a convenient and easily handled case which prevents damage to the cards and printouts.

The obtainment of the objects of this invention is enabled through the provision of a case cover having an interlock recess in the upper surface thereof and recessed front and rear edges. The case container, which forms the bottom of the case, has a downwardly projecting storage recess which fits into the interlock recess in the case cover and has recessed front and rear edges similar to those in the case cover. The cover overlaps the sidewalls of the case container to reinforce the case and to prevent entry of dirt and moisture into the case. Toggle acting clamps are positioned on the case container front and rear edges adjacent the case cover and connect with latch posts on the cover to lock the cover in position on the case container. A handle attached to the front edge of the case container provides a convenient means for carrying the case. Two removable data card trays are positioned over the storage recess in the case container and rest on the lip formed between the sidewalls of the case bottom and the storage recess. Conventional card retaining plates slide on metal rods in the bottom of the data card trays to clamp the data cards in the tray if less than a full tray of cards are being transported. The case cover, case container and trays are formed of epoxy fiberglass or plastic as desired.

A better understanding of the subject invention will be enabled when the following written description is read in conjunction with the appended drawings in which.

Figure 1:
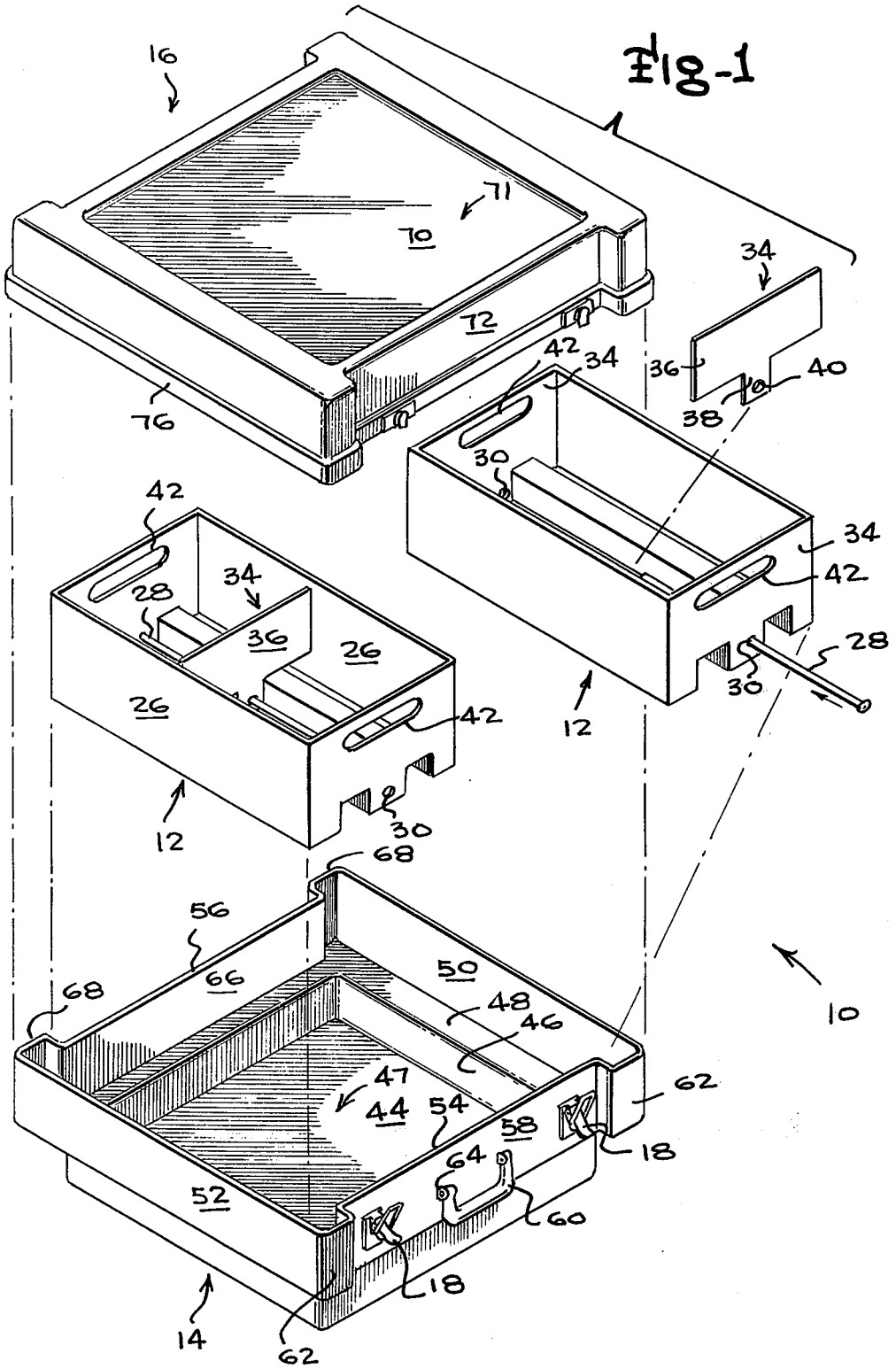
FIG. 1 is a perspective exploded view illustrating the preferred embodiment of the present invention.

Turning first to FIG. 1, it will be seen that a document transportation case 10 is disclosed and includes computer data card trays 12 which are carried in a case container 14 and are retained in position and protected by a case cover 16 which is attached to the case container by toggle latches 18.

Figure 3:
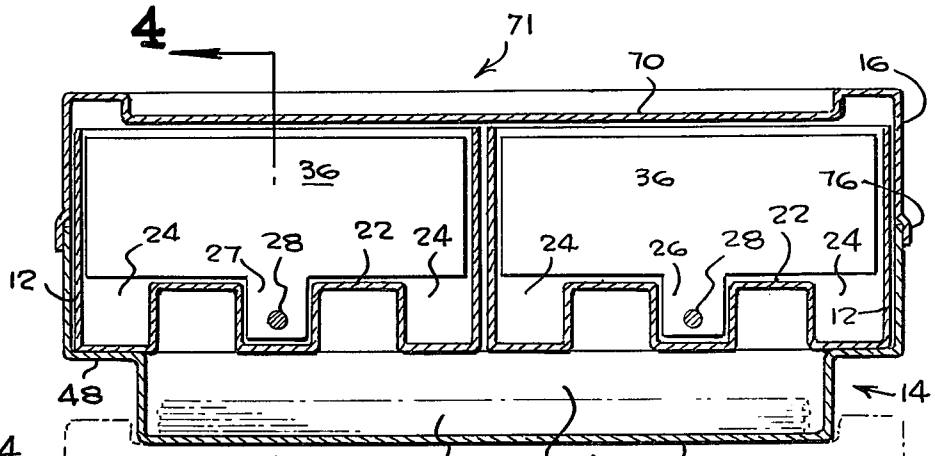
FIG. 3 is a sectional view of the preferred embodiment of the present invention taken along lines 3—3 of FIG. 2.
Figure 4:
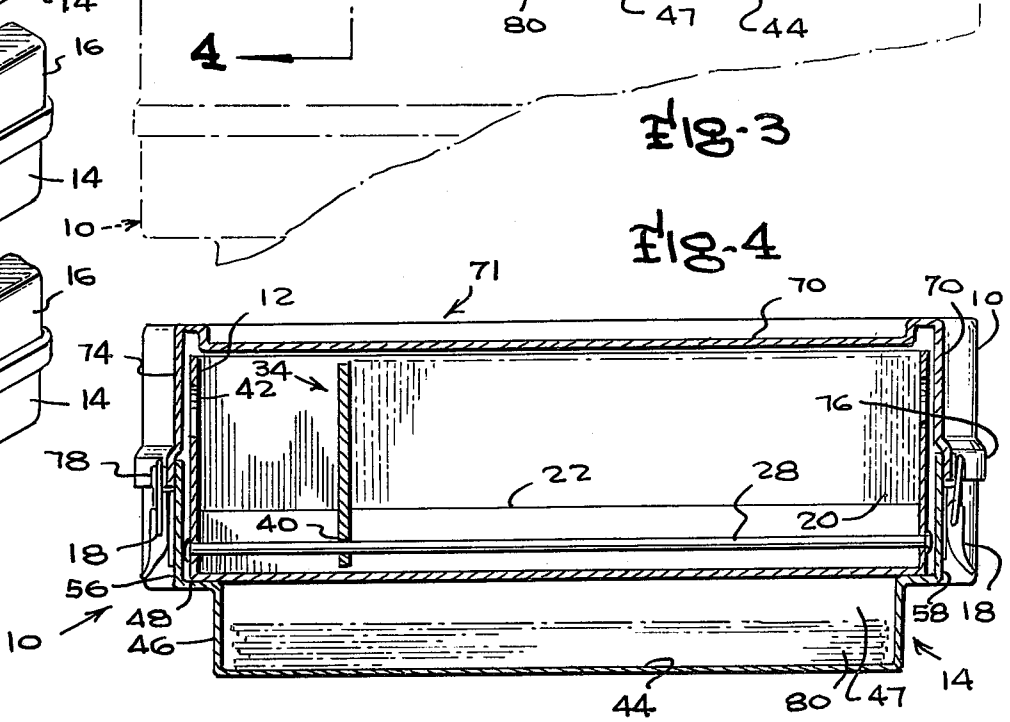
FIG. 4 is a sectional view taken along line 4—4 of FIG. 3.

Data cards 20 to be carried in the tray 12, as shown in FIG. 4, determine the width and depth of the tray which is in the form of an elongated open topped box having a tray bottom 22 with two upwardly opening channels 24 adjacent the side walls 26 and a similar center channel 27 positioned in the center of the tray bottom 22 as shown in FIG. 3. The channels 24 and 27 strengthen the trays and prevent them from buckling; particularly, when the trays are formed of a lightweight plastic material. The center channel 27 provides clearance for a guide rod 28 which is retained in holes 30 in the end walls 32 of the tray as shown in FIG. 1.

A compression plate 34, formed of a relatively thin rigid material such as sheet steel, has an upper portion 36 approximately equal to the size of the data cards with a downwardly extending central portion 38 with a slide opening 40 which is a hole approximately equal in diameter to the guide rod 28. The compression plate 34 is free to slide back and forth on the guide rod 28. However, the slide opening 40 grips the rod when the compression plate 34 is tilted thereby locking the data cards against the end of the tray when the tray is less than filled as shown in FIG. 4. Handles 42 in the ends of the trays permit easy removal of the trays from the case container 14 and subsequent handling. The trays are preferably formed of a lightweight rigid plastic material or epoxy fiberglass combination although they may be formed of metal such as steel or aluminum.

Figure 2:
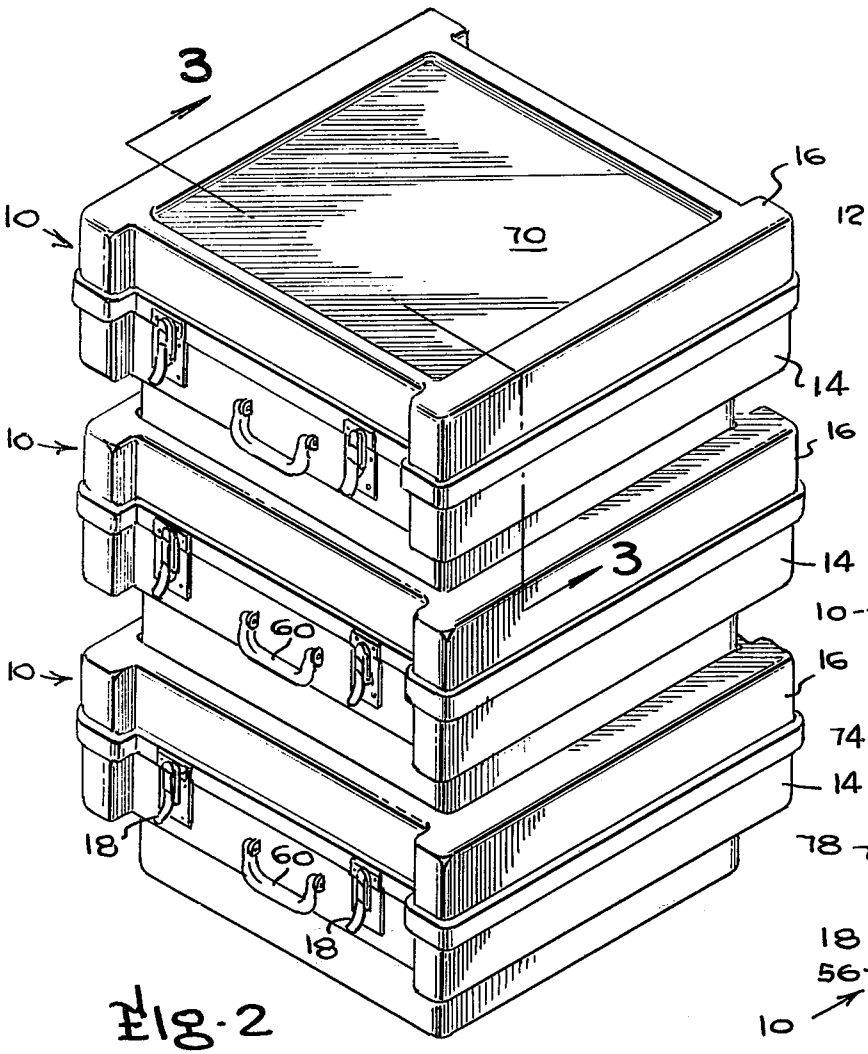
FIG. 2 is a perspective view illustrating three stacked cases of the preferred embodiment of the present invention shown in FIG. 1 with the printout storage recess in the bottom of the upper cases inserted into and retained by the interlock recess in the adjacent lower cover.

The lower portion of the document transportation case 10 is formed by the case container which is an open topped box having a recessed bottom 44 shown in FIGS. 1, 3 and 4. The recessed bottom 44 is shorter in length than the two trays 12 and narrower in width than the two trays. The recessed bottom 44 has outwardly inclined sidewalls 46 to form the storage recess 47 for transporting computer printouts 49 as shown in FIGS. 3 and 4. The upper edges of the inclined sidewalls 46 join with a tray supporting ledge 48 which extends outwardly from the sidewalls 46 thereby providing a support surface for the card trays 12 as shown in FIGS. 3 and 4. The outer edges of the tray supporting ledge 48 connects to the case container sidewalls 50 and 52, the case container front wall 54 and the case container back wall 56. The case container front wall 54 has a recessed center portion 58 on which a carrying handle 60 and toggle latches 18 are mounted. The recessed center portion 58 reduces damage to the latches and handle when the transportation cases are stacked since the adjoining end areas 62 on the front wall 54 will abut adjacent cases or walls thereby preventing contact with the latches 18 or the carrying handle 60. As can be seen in FIGS. 1 and 2, the carrying handle 60 has pivot brackets 64 mounted on recessed center portion 58 to permit the carrying handle 60 to be pivoted out of interference with any adjacent surfaces. The rear sidewall 56 has a recessed center portion 66 similar to the recessed center portion 58 of the front wall 54 to similarly protect the toggle latches 18 mounted thereon and to form similar rear wall end areas 68.

The construction of the case cover 16 is similar to the case container 14 and generally forms a downwardly opening box. An inwardly displaced recess surface 70 in the top of the cover forms an interlock recess displaced to receive the storage recess 47 of the case container 14 when the transportation cases are stacked as shown in FIGS. 2 and 3. The case cover 16 has sidewalls which form continuations of the case container sidewalls 50 and 52, front wall 54 and rear wall 56 with matching recessed portions 72 and 74 on the front and rear wall of the case cover as shown in FIG. 4. The lower edge of the case cover sidewalls have an outwardly displaced lip 76 which slides over the case container sidewalls as shown in the various figures to form a relatively tight seal between the case cover and the case container to exclude dust, dirt and water from the interior of the case when the case is closed. Latching posts 78 are mounted on the front recessed portion and the back recessed portion of the case cover adjacent the toggle action latches 18 mounted on the case container which permits locking the case cover on the case container while the cases are being transported or stored. The height between the tray supporting ledge 48 and the top recessed surface 70, when the case is assembled as shown in FIGS. 3 and 4, is slightly higher than the height of the card tray 12 which prevents any shifting of the tray 12 and the cards 20 while the case is being transported. The lengths of the sidewalls in the case cover and case container are sized to provide a small clearance between the case and the trays when two trays are being transported in the case as shown in FIGS. 3 and 4. The case cover and the case container are preferably molded from a tough, durable plastic material. However, they may be formed from a metal such as steel, as desired. The toggle latches 18, latch posts 78, and carrying handle 60, are conventional hardware on briefcases and the like.

The manner of use of the present invention is apparent from FIGS. 3 and 4. The computer printouts 49 are placed in the storage recess 47 of the case container 14 and two card trays 12 filled with the computer cards 20 are placed against the tray-supporting ledge 48 of the case container. The case cover 16 is positioned over the case container 14 with the displaced lip 76 overlapping the sidewalls of the case container. The toggle latches 18 are clamped over the latch posts 78 to lock the case cover on the case container. The case may then be carried by grasping carrying handle 60 or the cases may be stacked as shown in FIGS. 2 and 3 by positioning the recessed bottom 44 adjacent the top recessed surface 70, thereby producing an interlocked stack of transportation cases which will not slide sideways with respect to one another. After being transported to the destination, the cases may be conveniently stored or opened to retrieve the data cards and computer printouts.

It is to be understood that numerous modifications of the disclosed embodiments of the subject invention will undoubtedly occur to those of skill in the art and the spirit and scope of the invention is to be limited solely in light of the appended claims.

I claim:

1. A document transportation case for carrying and storing computer data cards, computer printouts and the like, said case comprising at least one elongated tray in which the computer cards may be carried, a case container of open-topped box configuration to receive the tray, said case container having a bottom surface with a printout storage recess projecting outwardly from said bottom surface, a support surface on the inside of the case container adjacent the printout-storage recess to support the card tray above the printout-storage recess when the tray is placed in the case container, a case cover of open-topped box configuration having a top surface and an inwardly directed recess in said top surface which is complementary to said print-out-storage recess in the case container, thereby permitting transportation cases to be stacked with the recesses of adjacent cases interlocking to prevent any sliding between adjacent cases, and locking means for retaining the case cover on the case container.

2. The document transportation case of claim 1 wherein the locking means are positioned in latch recesses on the sides of the case cover and case container to prevent damage to the locking means during storage and transporting.

3. The document transportation case of claim 1 wherein the locking means comprises a toggle-action latch and latching posts mounted between the case cover and the case container.

4. The document transportation case of claim 1 wherein the card tray has an upwardly opening channel extending along the center of the bottom of the tray, a guide rod positioned therein, and a compression plate having a slide hole in the base thereof which fits over the guide rod thereby providing a means for compressing the computer data cards being carried in the tray.

5. The document transportation case of claim 4 wherein the bottom of the card tray has two additional upwardly opening channels positioned parallel to the central channel between the center channel and the side walls of the tray.

6. The document transportation case of claim 1 wherein the case cover overlaps the case container when the case cover is installed on the case container, thereby preventing the entry of dust, dirt, rain and the like.

7. The document transportation case of claim 2 wherein the locking means are positioned in latch recesses on the sides of the case cover and case container to prevent damage to the locking means during storage and transporting and wherein the case cover and case container are sized to retain the card tray and prevent the tray from sliding relative to the case when the case is being transported.

8. The document transportation case of claim 7 wherein the locking means comprises a toggle-action latch and latching posts mounted between the case cover and the case container.

9. The document transportation case of claim 8 wherein the card tray has an upwardly opening channel extending along the center of the bottom of the tray, a guide rod positioned therein and a compression plate having a slide hole in the base thereof which fits over the guide rod thereby providing a means for compressing the computer data cards being carried in the tray.

10. A document transportation case for carrying and storing computer data cards, computer printouts, and the like, said case comprising two elongated card-carrying trays having sidewalls and endwalls to form an upwardly opening box and a bottom with upwardly opening channels adjacent the sidewalls and a central channel, a guide rod extending over the length of the central channel and through the endwalls of the tray, a compression plate having an upper portion and a downwardly projecting central portion with a slide hole in the central portion for mounting over the guide rod to provide a compression plate for compressing data cards carried in the card trays, a case container having sidewalls and a bottom to form an upwardly opening box, said bottom having a downwardly projecting printout storage recess and a tray-supporting surface between the storage recess and the sidewall of the case container, said sidewalls dimensioned to retain the two card trays in a horizontal side-by-side position, two opposite sidewalls of the case container having latch recesses in the sidewalls extending to the upper edges of the sidewalls, a case cover forming a downwardly opening box and having a top surface and sidewalls with an outwardly displaced lip extending around the lower edge thereof which overlaps the sidewalls of the case container when the case cover is installed over the open end of the case container, said case cover having an inwardly directed recess in said top surface which is complementary to the printout storage recess in the case container thereby permitting transportation cases to be stacked with the recesses interlocking to prevent any sliding between adjacent cases during storing and transporting and said case cover being sized to fit closely over the card tray when it is positioned on the support surface in the case container, toggle-action latches mounted in the latch recesses on the case container and latch posts mounted in similar latch recesses on the case cover to interact with the toggle-action latches to lock the case cover on the case container during storing and transporting and a carrying handle pivotally mounted in one of the latch recesses on the case container.

* * * * *